US011841015B2

(12) United States Patent
Martens et al.

(10) Patent No.: US 11,841,015 B2
(45) Date of Patent: Dec. 12, 2023

(54) FLUID-INJECTED COMPRESSOR INSTALLATION

(71) Applicant: ATLAS COPCO AIRPOWER, NAAMLOZE VENNOOTSCHAP, Wilrijk (BE)

(72) Inventors: Kristof Adrien Laura Martens, Wilrijk (BE); Cornelis Theodorus Philippi, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 630 days.

(21) Appl. No.: 17/044,566

(22) PCT Filed: Mar. 21, 2019

(86) PCT No.: PCT/IB2019/052304
§ 371 (c)(1),
(2) Date: Oct. 1, 2020

(87) PCT Pub. No.: WO2019/197919
PCT Pub. Date: Oct. 17, 2019

(65) Prior Publication Data

US 2021/0095668 A1 Apr. 1, 2021

(30) Foreign Application Priority Data

Apr. 11, 2018 (BE) ..... 2018/5246

(51) Int. Cl.
*F04C 18/16* (2006.01)
*F04C 23/02* (2006.01)
(Continued)

(52) U.S. Cl.
CPC ..... *F04C 18/16* (2013.01); *F04C 23/02* (2013.01); *F04C 27/004* (2013.01); *F04C 29/02* (2013.01);
(Continued)

(58) Field of Classification Search
CPC ..... F04C 18/16; F04C 23/02; F04C 27/004; F04C 29/02; F04C 2240/30; F04C 2240/40; F04C 2240/50; F04C 29/042
See application file for complete search history.

(56) References Cited

U.S. PATENT DOCUMENTS 4,780,061 A 10/1988 Butterworth
5,222,874 A * 6/1993 Unnewehr ..... F04C 29/045 417/372
(Continued)

FOREIGN PATENT DOCUMENTS

BE 1016596 A3 2/2007
CN 203742985 U 7/2014
(Continued)

OTHER PUBLICATIONS

International Search Report for PCT/IB2019/052304 dated, Feb. 4, 2020 (PCT/ISA/210).
(Continued)

*Primary Examiner* — Bryan M Lettman
(74) *Attorney, Agent, or Firm* — Sughrue Mion, PLLC

(57) ABSTRACT

A fluid-injected compressor installation (1) comprises a screw compressor (2) with a compression housing (4) in which a pair of compressor rotors (6*a*, 6*b*) are mounted. A drive motor (3) drives the compressor rotors. An inlet (7) and an outlet (8) on the screw compressor (2) supply a gas and discharge compressed gas. A gear transmission (20) between the shaft (16) of one of the compressor rotors and the motor shaft (11), includes a driven gear (18) and a
(Continued)

driving gear (19); a motor bearing (21) on the motor shaft (11) next to the driving gear (19); and a dynamic seal (25) next to the motor bearing (21), on the drive motor (3) side, such that the motor bearing (21) is between the driving gear (19) and the seal (25).

13 Claims, 2 Drawing Sheets

(51) Int. Cl.
*F04C 27/00* (2006.01)
*F04C 29/02* (2006.01)

(52) U.S. Cl.
CPC ..... *F04C 2240/30* (2013.01); *F04C 2240/40* (2013.01); *F04C 2240/50* (2013.01)

(56) References Cited

U.S. PATENT DOCUMENTS

| | | | | |
|---|---|---|---|---|
| 6,287,088 | B1 | 9/2001 | Nishimura | |
| 6,612,820 | B1 * | 9/2003 | Staat | F04C 27/009 418/104 |
| 9,506,469 | B2 * | 11/2016 | Morita | F04C 29/005 |
| 2012/0156079 | A1 | 6/2012 | Hirata et al. | |
| 2018/0238329 | A1 * | 8/2018 | Kasahara | F04C 18/16 |

FOREIGN PATENT DOCUMENTS

| | | | |
|---|---|---|---|
| CN | 104204530 | A | 12/2014 |
| CN | 107624149 | A | 1/2018 |
| DE | 299 04 410 | U1 | 8/2000 |
| DE | 10 2016 011 394 | A1 | 3/2018 |
| EP | 1 447 566 | A1 | 8/2004 |
| EP | 2 119 915 | A2 | 11/2009 |
| JP | 3041508 | B2 | 5/2000 |
| JP | 2007-192046 | A | 8/2007 |
| JP | 2008-19747 | A | 1/2008 |
| WO | 83/03641 | A1 | 10/1983 |
| WO | 00/42322 | A1 | 7/2000 |
| WO | 2007/022605 | A1 | 3/2007 |
| WO | 2013/126969 | A1 | 9/2013 |
| WO | 2013/126970 | A1 | 9/2013 |
| WO | 2017/154771 | A1 | 9/2017 |

OTHER PUBLICATIONS

Written Opinion of the International Searching Authority for PCT/IB2019/052304 (PCT/ISA/237).

* cited by examiner

FLUID-INJECTED COMPRESSOR INSTALLATION

CROSS-REFERENCE TO RELATED APPLICATIONS

This application is a National Stage of International Application No. PCT/IB2019/052304, filed on Mar. 21, 2019, which claims priority from Belgian Patent Application No. 2018/5246, filed on Apr. 11, 2018, the contents of all of which are incorporated herein by reference in their entireties.

BACKGROUND OF THE INVENTION

Field of the Invention

The present invention concerns a fluid-injected compressor installation.

More specifically, the invention is intended for fluid-injected compressor installations that are provided with a fluid-cooled drive for driving the compressor element.

The aforementioned fluid can be, for example, oil or water.

Background

Such compressor installations are already known from WO 2013/126969 and WO 2013/126970, with the drive being a motor with a variable rotational speed or a so-called "variable speed drive" and with the drive and the compressor element being directly coupled to each other and standing in a vertical arrangement with the drive on top.

The housing of the motor and the compressor element forms a whole and there is one integrated cooling circuit for cooling and lubricating both the drive and the compressor element, with the combination of pressure and gravity being used to drain the fluid out of the drive.

In this way, seals can be saved. Furthermore, no intake valve is needed because a motor with a variable rotational speed is used and a non-return valve in the exhaust is also not needed because the housings together form a whole in which the pressure is uniformly equal.

For larger compressor elements and the corresponding drives, i.e. with a greater power, some problems are known with such installations.

Firstly, due to the size, the height of such compressor installations is too great and impractical. Furthermore, the centre of gravity is very high so that additional support must be provided.

Secondly, the direct coupling of the drive with the compressor element is disadvantageous in the case of large compressor installations due to the typically lower operating rotational speeds of the larger compressor element. A direct coupling always comes with the consequence that the motor with variable rotational speed must run at the same low speed as the compressor element, which causes a high torque. This leads to the need for an expensive and complicated drive which can generate such a high torque. A motor with a fixed rotational speed has the disadvantage that with a direct coupling, the compressor installation can only run at one rotational speed, and hence only one working pressure at this unique rotational speed can correspond to the available motor power.

In addition to such compressor installations with a vertical set-up, there are also compressor installations with a horizontal set-up, whereby the problem of the height does not, or almost does not, play a role.

In such known horizontal set-ups, in most cases there is a so-called elastic coupling present between the drive and the compressor element. In smaller set-ups, it is possible that these are built without an elastic coupling. Furthermore, the drive is not fluid-cooled, but air-cooled.

Such horizontal set-ups do not make it possible to provide an integrated fluid cooling for both, since in this case the housing of the drive and the compressor installation are two separated parts, with a housing between both for the coupling and possibly, but not necessarily, gears. The housing for the coupling is also typically completely free of fluid and is in contact with the ambient air in the compressor via ventilation openings. Such elastic couplings are typically not suited to function in an oil-containing atmosphere.

Due to the use of an elastic coupling, such a set-up is relatively voluminous.

The object of the present invention is to provide a solution for at least one of the aforementioned and other disadvantages.

SUMMARY OF THE INVENTION

The present invention has a fluid-injected compressor installation as subject, which is provided with at least:

- a screw compressor with a compression chamber which is formed by a compression housing in which a pair of cooperating screw-shaped compressor rotors are rotatably mounted;
- a drive motor which is provided with a motor chamber formed by a motor housing, in which a motor shaft is rotatably mounted which drives at least one of the two aforementioned screw-shaped compressor rotors;
- an inlet and an outlet on the screw compressor for the supply of a gas respectively for the discharge of compressed gas;
- with the compression housing and the motor housing being directly joined to each other to form a compressor housing; with the characteristic that the compressor installation is further provided with:
- a gear transmission between the shaft of one of the compressor rotors and the motor shaft, consisting of a driven gear on the shaft of the compressor rotor and a driving gear on the motor shaft;
- a motor bearing on the motor shaft next to the driving gear on the drive motor side;
- a dynamic seal next to the aforementioned motor bearing, on the drive motor side, such that the motor bearing is between the driving gear and the seal.

An advantage is that because the motor housing and the compression housing are not separated from each other, an integrated fluid circuit for cooling and/or lubrication can be implemented.

Another advantage is that because the motor housing and the compression housing are directly joined to each other, and because no elastic coupling is provided anymore and because the cooling of the drive motor is realised with the integrated cooling circuit and thus there a separate fan does not need to be provided anymore on the end of the drive motor for its cooling, a very compact set-up is achieved; whereby the entire compressor can also be built smaller.

An additional advantage is that the intermediate shaft with double bearings upon which at one end the driving gear and at the other end the driven part of the coupling is mounted, can be omitted. By omitting the elastic coupling, the driving gear can in this case be mounted directly on the motor shaft and an intermediate shaft is no longer needed. Omitting this intermediate shaft with double bearings also contributes to a more compact set-up of the compressor.

Another advantage is that by providing a gear transmission between the motor shaft and the shaft of the compressor rotor, the aforementioned disadvantages of a direct coupling in large compressor installations can be avoided and also that drives having a fixed rotational speed can be used.

Due to using the gear transmission, an extra motor bearing must be provided on the motor shaft compared to a direct coupling between the drive motor and the screw compressor.

This motor bearing is typically, but not necessarily, a cylindrical bearing.

By providing a dynamic seal between the motor bearing and the motor, it is possible to prevent fluid, used to lubricate and/or to cool the gear transmission and the bearing, from being able to flow to the motor housing.

This will allow positioning the aforementioned compressor installation in a horizontal set-up without the risk that too much fluid ends up in the motor housing, so that the height of the compressor installation can be limited.

Preferably, the motor housing is provided with drainage channels for the removal of a fluid.

This will allow fluid which still ends up in the motor housing to be removed so that it is avoided that fluid accumulates in the motor housing. The problem of the accumulation of fluid in the motor housing is twofold. On the one hand, the accumulated amount of fluid will lead to extra turbulence losses of the rotor if the rotor ends up in the fluid. On the other hand, the hot motor components will lead to a faster and thus undesired extra degradation of the accumulated fluid.

In a practical embodiment, the aforementioned dynamic seal is a labyrinth seal.

By using a labyrinth seal instead of a shaft seal with one or more sealing lips, also known as a lip-seal, the losses which come with the latter due to the contact and the corresponding friction between the static sealing lips and the rotating shaft can be avoided.

With a labyrinth seal there is, after all, no contact with the rotating shaft so that there is no friction loss.

The use of a labyrinth seal also has the advantage that this is maintenance-free; while a shaft seal with one or more sealing lips must be regularly replaced due to occurring wear, which is a very time-consuming and difficult intervention in the compressor.

Preferably, the labyrinth seal is made as a semi-circular groove in the shaft and a recess in the compressor housing with a slanting side towards the shaft in the direction of the motor bearing, with the recess being opposite the groove such that fluid that reaches the labyrinth via the motor bearing ends up in the groove, is pushed back upwards and away from the shaft to the recess in the housing, and through this recess back in the direction of the motor bearing.

An advantage of such a labyrinth seal design is that it is integrated in existing components of the machine and that no extra components are needed. In other words: the existing components of the machine perform the function of the labyrinth seal.

Also, no losses will occur owing to the seal. Lastly, there is no risk of damage or incorrect mounting of the labyrinth seal because it does not consist of extra, loose components. Therefore there is no risk of a loss of functionality. With classic shaft seals having one or more sealing lips, this risk is always present and therefore always demands the necessary attention during mounting and replacing.

BRIEF DESCRIPTION OF THE DRAWINGS

With the intention to illustrate better the characteristics of the invention, some preferential embodiments of a fluid-injected compressor installation according to the invention are described below, as example without any limitation, with reference to the accompanying drawings in which.

DETAILED DESCRIPTION OF THE INVENTION

Figure 1:
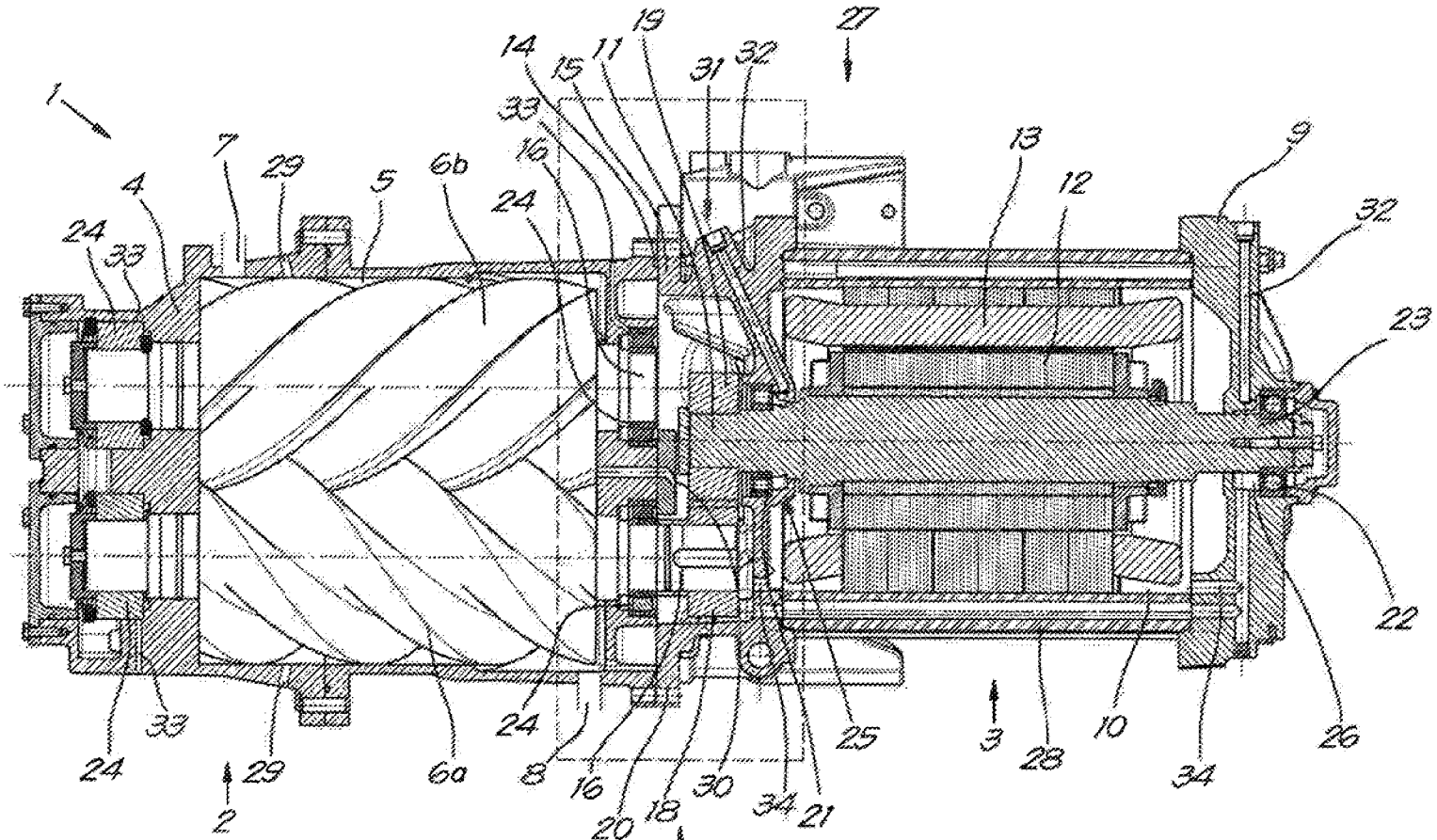
FIG. 1 schematically shows a fluid-injected compressor installation according to the invention.

The fluid-injected compressor installation 1 schematically shown in FIG. 1 principally comprises a screw compressor 2 and a drive motor 3.

The screw compressor 2 is provided with a compression housing 4 which defines the compression chamber 5 in which two cooperating screw-shaped compressor rotors 6*a*, 6*b* are rotatably mounted.

The screw compressor 2 is provided with an inlet 7 for the supply of a gas, e.g. air, and an outlet 8 for the discharge of gas compressed by the compressor rotors 6*a*, 6*b*.

The drive motor 3 is provided with a motor housing 9 which defines the motor chamber 10 in which a motor shaft 11 is rotatably mounted. The motor shaft 11 will drive at least one of the compressor rotors 6*a*, 6*b*.

In the example of FIG. 1, the drive motor 3 is an electric motor 3 with a motor rotor 12 and a motor stator 13 with the motor shaft 11 being part of the motor rotor 12.

Preferably, both the motor housing 9 and the compression housing 4 are cast components. It is not excluded that both housings are composed of several separate components, with these assembled components being cast, machined or extruded, or produced by means of any other type of production process.

The compression housing 4 and the motor housing 9 are directly joined to each other and together form the compressor housing 14, with the motor chamber 10 and the compression chamber 5 not being sealed relative to each other.

This implies that the pressure which is present in the compression housing 4 is allowed to prevail also in the motor housing 9.

As can be seen in FIG. 1, the motor housing 9 is provided with a flange 15 on the screw compressor 2 side with which the motor housing 9 is attached to the compression housing 4 of the screw compressor 2.

In this case, the shafts 16 of the compressor rotors 6*a*, 6*b* and the motor shaft 11 extend in an axial direction X-X' which is horizontal.

For the invention, it is not excluded that these shafts 6*a*, 6*b*, 11 extend substantially horizontally, in other words, at an angle to the horizontal direction that is less than 45°.

According to the invention, the motor shaft 11 is not directly coupled to the shaft 16 of the compressor rotor 6*a* which is driven, but there is a gear transmission 17 provided between the shaft 16 of the compressor rotor 6*a* and the motor shaft 11.

This gear transmission 17 includes a driven gear 18 on the shaft 16 of the compressor rotor 6*a* and a driving gear 19 on the motor shaft 11.

The aforementioned flange 15 of the motor housing 9 is made such that it can serve as the housing for the driven gear 18 and the driving gear 19.

In other words: the flange 15 is part of or forms the gearbox 20.

Due to the fact that the motor shaft 11 is not directly coupled to the shaft 16 of the compressor rotor 6*a*, there is also a motor bearing 21 on the motor shaft 11 next to the driving gear 19 on the side of the drive motor 3.

Next to this motor bearing 21, there is also a bearing 22 provided on the other end 23 of the motor shaft 11. Further, the shafts 16 of both compressor rotors 6*a*, 6*b* are provided with one or more bearings 24 at their ends.

Further, also a dynamic seal 25 is provided on the motor shaft 11 next to the aforementioned motor bearing 21 which is situated on the side of the drive motor 3 so that the motor bearing 21 is between the driving gear 19 and the seal 25.

This seal 25 can be a shaft seal with one or more sealing lips, also called a lip-seal, but is in this case preferably a labyrinth seal.

Both the aforementioned motor bearing 21 and the seal 25 are in the gearbox 20 formed by the flange 15 of the motor housing 9.

Also a seal 26 is provided next to the bearing 22 which is provided on the other end 23 of the motor shaft 11.

Both seals 25, 26 will ensure that no or almost no fluid which is used to lubricate the bearings 21, 22 can get into the motor housing 9 of the drive motor 3.

The compressor installation 1 is further provided with a fluid by which both the drive motor 3 and the compressor rotors 6*a*, 6*b* can be cooled and/or lubricated. This fluid can be water, a synthetic or non-synthetic oil or any other type of fluid.

For this, the compressor installation 1 is provided with a cooling circuit 27 which first sends the fluid to the drive motor 3 and then it is injected into the screw compressor 2.

The cooling circuit 27 consists of, among others, cooling channels which are or are not integrated in the compressor housing 14 and with which the fluid is circulated in the compressor installation 1.

The drive motor 3 is provided with a cooling jacket 28 in which the fluid can flow. The screw compressor 2 is provided with a number of injection points 29 to allow the fluid to be injected in the compression housing 4.

The cooling circuit 27 will send the fluid first to the cooling jacket 28 and then to the injection points 29. The cooling circuit 27 can however also be provided such that only a portion of the fluid is sent first to the cooling jacket 28 and then to the injection points 29, and that the rest of the fluid is sent directly to the injection points 29 in order to achieve a smaller fluid flow in the cooling mantel 28 in this way.

Further, the screw compressor 2 is provided with nozzles 30 to conduct a portion of the fluid to the aforementioned gears 18, 19. This means that the nozzles 30 will inject fluid in the gearbox 20. Via a reservoir 35 in the gearbox 20, a portion of the oil injected via the nozzles 30 which is thrown upwards by the gears 18, 19 can also be brought to the bearing 21.

The cooling circuit 27 also includes a branch 31 which will conduct fluid to the bearings 21, 22, 24 of the compressor installation 1. In this case, the branch 31 comprises two drain channels 32 to the motor bearing 21 and the bearing 22 at the end 23 of the motor shaft 11 and also drain channels 33 to the bearings 24 of the compressor rotors 6*a*, 6*b*. These last drain channels 33 can however also be completely or partially replaced by the nozzles 30 in the case that these also conduct fluid to the bearing(s) 24A.

In other words, the oil which is sent to the bearings 21, 22, 24 of the compressor installation 1, will not pass through the cooling circuit 27 via the cooling jacket 28 and the injection points 29 and the compression housing 4, but will be conducted directly to the bearings 21, 22, 23.

By providing an additional filter in the branch 31, this portion of the fluid can be filtered more and better, which is advantageous but not necessary for the service life of the bearings 21, 22 and 24.

Besides this, an additional cooler can also be provided in the branch 31 which lowers the temperature of the portion of the fluid which is sent to the bearings 21, 22 and 24, which provides improved lubricating properties of the fluid. Because in this way the entire fluid flow does not need to be cooled to this lower temperature, the total cooling capacity of the compressor installation 1 is limited and the formation of condensate in the mixture of compressed gas and fluid at the outlet 8 of the screw compressor 2 can be prevented.

Further, the motor housing 9 is provided with drain channels 34 for the discharge of fluid that ends up in the drive motor 3, e.g. as a result of a small leak through the labyrinth seals 25 and 26 for the lubrication and cooling of the motor bearing 21 and the bearing 22 on the other end 23 of the motor shaft 11 with the fluid.

These drainage channels 34 may or may not be part of the aforementioned cooling circuit 27.

The drainage channels 34 enable the fluid to be discharged to the gear transmission 17.

Hereby it is possible that in the drainage channels 34 means are provided to discharge or push the fluid to the gear transmission 17. This can be necessary if the drainage channels 34 are at a lower level than the gear transmission 17 necessitating that the fluid is pushed upwards.

The functioning of the compressor installation 1 is very straightforward and as follows.

During the operation of the compressor installation 1, the drive motor 3 will drive the shaft 16 of the compressor rotor 6*a*, with the rotation of the motor shaft 11 being transmitted via the gears 18, 19 to the shaft 16 of the compressor rotor 6*a*.

Hereby, the two compressor rotors 6*a*, 6*b* will rotate around their respective shafts 16 and compress air which is sucked in via the inlet 7. The compressed air will leave the compressor installation 1 via the outlet 8 and, for example, be fed to a consumer network.

During the operation of the compressor installation 1, this will be lubricated and cooled by means of a fluid.

For this, the fluid will be circulated in the cooling circuit 27.

First, the fluid is sent to the drive motor 3 where it will flow through the cooling jacket 28 and cool the drive motor 3.

Subsequently, it will be conducted to the screw compressor 2 via the cooling channels and injected in the compression housing 4 via the injection points 29 to ensure the sealing, cooling and lubrication of the compressor rotors 6*a*, 6*b*.

Further, fluid will be injected in the gearbox 20 from the screw compressor 2 via the nozzles 30, that is to say, to the gears 18, 19 to lubricate the latter.

It is self-evident that also the bearings 21, 22, 24 of the compressor installation 1 must be provided with the needed lubrication and cooling.

For this, the aforementioned branch 31 is used with the drain channels 32, 33 which diverts fluid from the cooling circuit 27 to send this to the bearings 21, 22, 24.

This means that the fluid for the bearings will not flow via the drive motor 3. This fluid will re-enter the cooling circuit of the screw compressor 2 after flowing through the bearings 21, 22, 24.

The drain channels 32, 33 conduct the fluid to the motor bearing 21, the bearing 22 on the other end 23 of the motor shaft 11 and the bearings 24 of the screw compressor 2.

By providing a separate branch 31, the fluid that is separated therewith for the bearings 21, 22, 24 can still be additionally filtered by providing a filter in the branch 31.

Besides the use of branch 31 and drain channels 32 to supply the motor bearing 21 with fluid, this motor bearing 21 can also be lubricated with fluid from the reservoir 35.

During the operation of the compressor installation 1, the gears 18, 19 will rotate and the fluid which ends up in the gearbox 20 via the nozzles 30 will be thrown upwards so that it ends up in the reservoir 35.

Via this fluid collected in the reservoir 35, the motor bearing 21 can be additionally lubricated.

Despite the fact that the motor bearing 21 and the other bearing 22 on the motor shaft 11 are provided with a seal 25, 26 to prevent fluid being injected in these bearings 21, 22 ending up in the motor housing 9, it is still possible that fluid leaks into the motor housing 9.

This fluid will be able to flow away via the thereto provided drainage channels 34. The drainage channels 34 conduct the fluid to the gearbox 20 where it is taken up in the cooling circuit 27.

Due to the horizontal set-up of the compressor installation 1, no use can be made of gravity to prevent the motor housing 9 becoming completely filled with the fluid through the flowing away of the fluid under the influence of gravity, these drainage channels 34 are needed.

In this way, the compressor installation 1 can be cooled and lubricated with just one integrated cooling circuit 27, whereby simultaneously it is ensured that the motor housing 9 is not filled with fluid.

Figure 2:
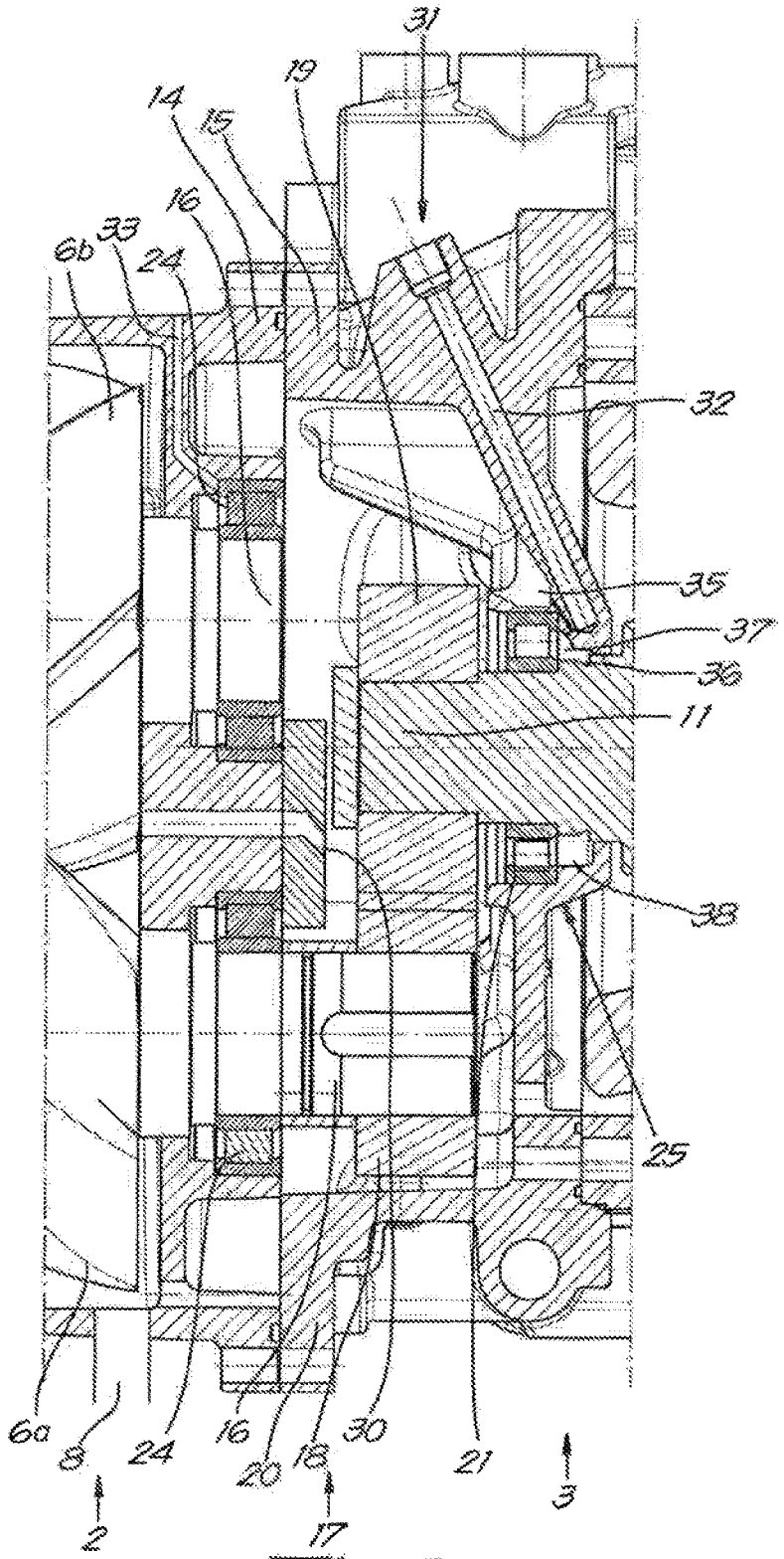
FIG. 2 shows the part marked as F2 in FIG. 1 on a larger scale.

In FIG. 2, the gear transmission 20 of FIG. 1 is shown in more detail, with it being clearly visible that the labyrinth seal 25 is not made as a separate component that is mounted on the motor shaft 11, but as an integrated component which is realized by giving the motor shaft 11 and the motor housing 9 near the motor bearing 21 a special shape.

A semi-circular groove 36 is provided in the motor shaft 11. In the compressor housing 14, more specifically in the motor housing 9, a recess 37 is provided with a slanting side 38 towards the motor shaft 11 in the direction of the motor bearing 21.

The groove 36 is opposite to the recess 37 so that fluid which reaches the seal 25 via the motor bearing 21 ends up in the groove 36 and is pushed back upwards, away from the motor shaft 11.

In this way, it is sent to the recess 37 where it is sent via the slanting side 38 back in the direction of the motor bearing 21.

In this way, it is possible to avoid that fluid comes past the labyrinth seal 25, i.e. ends up in the drive motor 3.

The present invention is in no way limited to the embodiment described as an example and shown in the figures, but a fluid-injected compressor installation according to the invention can be realised in all shapes and sizes without falling outside the scope of the invention.

The invention claimed is:

1. A fluid-injected compressor installation (1), comprising:

a screw compressor (2) with a compression chamber (5) which is formed by a compression housing (4) in which a pair of cooperating screw-shaped compressor rotors (6*a*, 6*b*) are rotatably mounted;

a drive motor (3) which is provided with a motor chamber (10) formed by a motor housing (9) in which a motor shaft (11) is rotatably mounted which drives at least one of the two aforementioned screw-shaped compressor rotors (6*a*, 6*b*);

an inlet (7) and an outlet (8) on the screw compressor (2) for the supply of a gas respectively for the discharge of compressed gas;

with the compression housing (4) and the motor housing (9) being directly joined to each other to form a compressor housing (14);

wherein the compressor installation (1) further comprises:

a gear transmission (20) between the shaft (16) of one of the compressor rotors (6*a*, 6*b*) and the motor shaft (11), consisting of a driven gear (18) on the shaft (16) of the compressor rotor (6*a*, 6*b*) and a driving gear (19) on the motor shaft (11);

a motor bearing (21) on the motor shaft (11) next to the driving gear (19) on a drive motor side (3) thereof;

a dynamic seal (25) next to the aforementioned motor bearing (21), on the drive motor (3) side, such that the motor bearing (21) is between the driving gear (19) and the seal (25), wherein the dynamic seal (25) is a labyrinth seal which is made as a semi-circular groove (36) in the motor shaft (11) and a recess (37) in the motor housing (9) having a side (38) slanting away from the motor shaft (11) in a direction of the motor bearing (21), with the recess (37) facing the groove (36) such that fluid which reaches the labyrinth seal (25) via the motor bearing (21) ends up in the groove (36), is pushed back and radially away from the motor shaft (11) to the recess (37) in the motor housing (9), and is sent through this recess (37) back in the direction of the motor bearing (21).

2. The fluid-injected compressor installation according to claim 1, wherein it is provided with a fluid by which both the drive motor (3) and the compressor rotors (6*a*, 6*b*) are cooled and/or lubricated.

3. The fluid-injected compressor installation according to claim 2, wherein it is provided with a cooling circuit (27) which first sends the fluid to the drive motor (3) and then it is injected into the screw compressor (2).

4. The fluid-injected compressor installation according to claim 3, wherein the screw compressor (2) is provided with nozzles (30) to conduct a portion of the fluid to the gears (18, 19).

5. The fluid-injected compressor installation according to claim 3, wherein the cooling circuit (27) is provided with a branch (31) which will conduct fluid to the bearings (21, 22, 24) of the compressor installation (1).

6. The fluid-injected compressor installation according to claim 5, wherein the cooling circuit (27) is provided with a filter in the branch (31).

7. The fluid-injected compressor installation according to claim 5, wherein the cooling circuit (27) is provided with a cooler in the branch (31).

8. The fluid-injected compressor installation according to claim 1, wherein the motor housing (9) is provided with drainage channels (34) for discharging a fluid.

9. The fluid-injected compressor installation according to claim 8, wherein the drainage channels (34) discharge the fluid to the gear transmission (17).

10. The fluid-injected compressor installation according to claim 8, wherein the drainage channels (34) means are provided in order to discharge or push the fluid to the gear transmission (17).

11. The fluid-injected compressor installation according to claim 1, wherein the shafts (16) of the compressor rotors (6*a*, 6*b*) and the motor shaft (11) extend in an axial direction (X-X') which is substantially horizontal which is substantially orthogonal to gravity.

12. The fluid-injected compressor installation according claim 1, wherein a reservoir (35) is provided to the motor bearing (21) for collecting fluid.

13. The fluid-injected compressor installation according to claim 1, wherein the motor housing (9) is provided with a flange (15) on a screw compressor (2) side, which is formed to house the driven gear (18) and the driving gear (19).

* * * * *